United States Patent [19]

Kogler

[11] 4,108,494

[45] Aug. 22, 1978

[54] CUTTING MACHINE

[75] Inventor: Peter Kogler, Knittelfeld, Austria

[73] Assignee: Vereinigte Osterreichische Eisen- und Stahlwerke-Alpine Montan Aktiengesellschaft, Austria

[21] Appl. No.: 796,705

[22] Filed: May 13, 1977

[30] Foreign Application Priority Data

May 13, 1976 [AT] Austria ..... 3504/76

[51] Int. Cl.[2] ..... E21C 27/20

[52] U.S. Cl. ..... 299/1; 299/75

[58] Field of Search ..... 299/1, 64, 75; 212/39 R, 39 A, 39 P; 251/322, 323; 91/400

[56] References Cited

U.S. PATENT DOCUMENTS

| | | | |
|---|---|---|---|
| 2,136,921 | 11/1938 | Joy | 299/1 |
| 2,376,019 | 5/1945 | Thomas | 212/39 A |
| 3,094,221 | 6/1963 | Galuska | 212/39 A |
| 3,169,797 | 2/1965 | Lundquist | 299/64 |
| 3,724,559 | 4/1973 | Stromnes | 173/40 |
| 3,920,217 | 11/1975 | Olsen | 91/400 |
| 3,942,752 | 12/1975 | Hoofnagle | 212/39 MS |

*Primary Examiner*—Ernest R. Purser
*Assistant Examiner*—William F. Pate, III
*Attorney, Agent, or Firm*—Cushman, Darby & Cushman

[57] ABSTRACT

A cutting machine having a universally movable cutting arm and cutting head assembly and a movable loading ramp assembly thereunder and means operatively associated with the cutting arm and loading ramp for controlling the operation thereof so as to prevent contact between the cutting arm and loading ramp by maintaining the vertical spacing therebetween in excess of a predetermined minimum.

6 Claims, 5 Drawing Figures

CUTTING MACHINE

Figure 1:
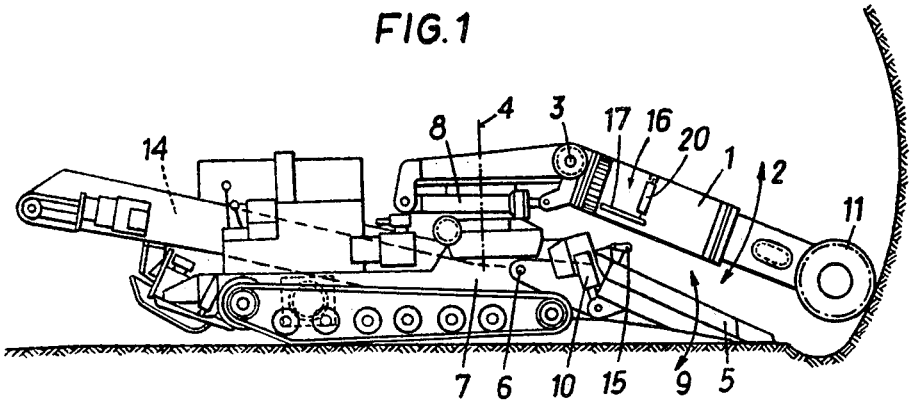

The invention concerns a cutting machine with a cutting arm which carries at least one cutting head and which can be swiveled around a horizontal axis and a vertical axis, and with a loading ramp which is disposed below the cutting arm and which can be lifted and lowered and swiveled around a horizontal axis and is pivoted at the frame of the cutting machine. In this case, hydraulic driving means are provided in the customary manner for the lifting and lowering movements of the cutting arm and the loading ramp. In the case of cutting machines in which the cutting arm can be swiveled in all directions and the loading ramp can be moved in upward direction, there is the danger of a collision of the cutting arm with the loading ramp when the loading ramp is moving upward which is sometimes necessary because of unevenness of the bottom and when the cutting arm is in a low position. Such a collision can result in large forces so that damage to the colliding parts as well as to the hydraulic driving means can be expected. The customarily provided movable loading arms, for example, which are operated to perform a hauling movement and continuously push the cut material on the loading ramp upward in hauling direction, are located on the upper side of the loading ramp, and in case of a collision of the cutting arm with the loading ramp, the loading arms may also collide with the cutting arm, so that there is the danger of damaging the loading arms. In order to eliminate such damage, shear pins were up to now used and inserted into the drive of the loading arms which break in the case of overloading which is supposed to eliminate a breaking of the loading arms or damage to the driving means. However, after each fracture, these shear pins must be replaced and this is a rather long process, so that when a shear pin breaks, there is a considerable operating stoppage.

In view of the performance of a cutting machine and in view of the fact that parts of the cutting machine which is used in underground operation cannot easily be exchanged, such an operating stoppage can be very expensive.

The invention aims at eliminating these disadvantages and essentially consists of the fact that the cutting arm and the loading ramp have, at a distance from their horizontal swivel axis, interacting stops, the height of which is dimensioned in such a way that they come in contact with each other before other parts of the cutting arm and loading ramp come in contact with each other. At least one of these stops is movable and operates valves which are inserted into the hydraulic leads which are pressurized when the cutting arm is lowered and when the loading ramp is raised. In this manner, before parts of the cutting machine can be damaged by the collision, the drive of the swiveling movement of the cutting arm and the loading bridge is interrupted in the direction of the collision. Since the drive is now turned off, the build-up of dangerous forces is avoided. In this case, the valves may be inserted into the hydraulic leads in such a way that in the rest position, they connect the hydraulic leads with the lifting cylinders and during operation, end in the movable stop of the hydraulic leads. However, preferably the arrangement according to the invention is carried out in such a way that the valves which are inserted into the hydraulic leads when operated, reach the open position and connect the hydraulic leads with the return flow. In this case, the hydraulic leads become pressureless and the movement of cutting ar and loading ramp is stopped immediately in the sense of an approaching of these structural parts. The hydraulic leads into which the valves are inserted, may, in the case of directly controlled hydraulic systems, be the work leads or in the case of servo-hydraulic systems, be the control leads. Finally, these valves, with the use of electric control leads which are switched as a function of the interacting stops, may also be opened and closed.

According to a preferred construction of the invention, the valves which are inserted into the hydraulic leads are formed by a sleeve valve which is spring-loaded and can be axially moved in a cylinder. This sleeve valve has two control grooves which, in the case of the shifting of the sleeve valve opposite the spring-loading connect control openings of the cylinder forming the valve face which are connected with the hydraulic leads, with control openings which are connected with a return flow lead. In this case, one control groove is assigned to the hydraulic lead of the cutting arm and one control groove to the hydraulic lead of the loading ramp. This results in a simple and safe construction in the case of which the valves assigned to the drive of the cutting arm and the drive of the loading ramp are combined into one structural unit. In this case, the movable stop is preferably formed by a bow which can be swiveled and which is supported by the spring-loaded sleeve valve. Such a bow has the advantage that it can extend over a larger length so that the interaction with the counter-stop in all positions of the cutting arm and loading ramp is insured. For this purpose, the bow and the valve formed by the sleeve valve and the cylinder are pivoted at the cutting arm. This has the advantage that the movable parts do not collide with the ripped or cut out material conveyed over the loading ramp, so that on one hand a damage and on the other hand an operational failure caused by such a collision are avoided.

The loading arms transport the material to a conveying device which is connected in the center to the upper end of the loading ramp, for example, to a conveyor belt. A passage must therefore be provided for the material above the loading ramp to the conveying device. This passage must be kept open and, within the framework of the inventions, it is therefore practical to provide the stops at both sides of the center of the loading ramp, and at both sides of the cutting arm so that the stops become effective, no matter whether the cutting arm approaches the loading ramp from the left or from the right.

In the drawing, the invention is explained by means of a construction example.

Figure 2:
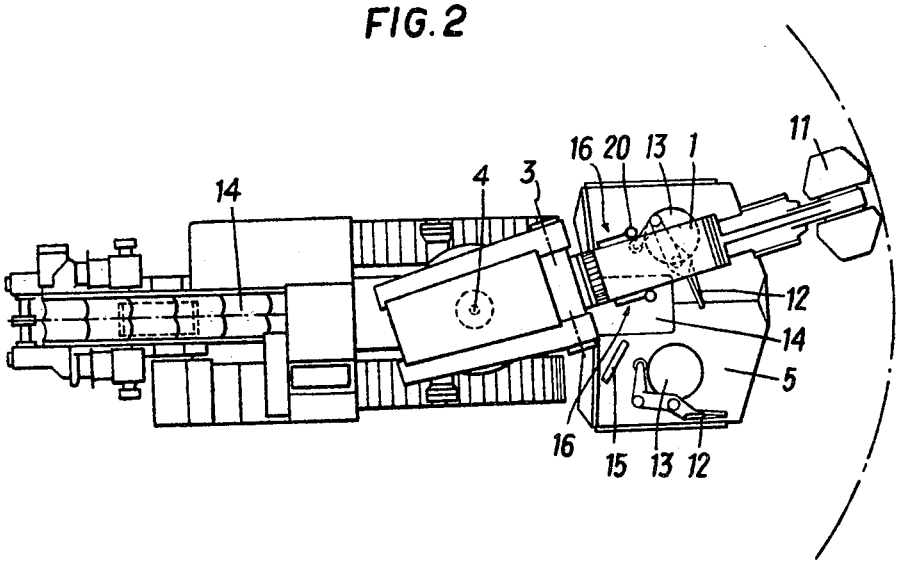

FIGS. 1 and 2 show a cutting machine, in which case FIG. 1 is a side view and FIG. 2 is an elevational view. At a larger scale, FIGS. 3 and 4 show a movable stop which is disposed at the cutting arm with the valve which is formed by the valve sleeve and the cylinder, in which case FIG. 3 shows a view in axial direction of the cutting arm, partially as a section, and FIG. 4 shows an elevational view in the direction of the arrow IV.

Figure 5:
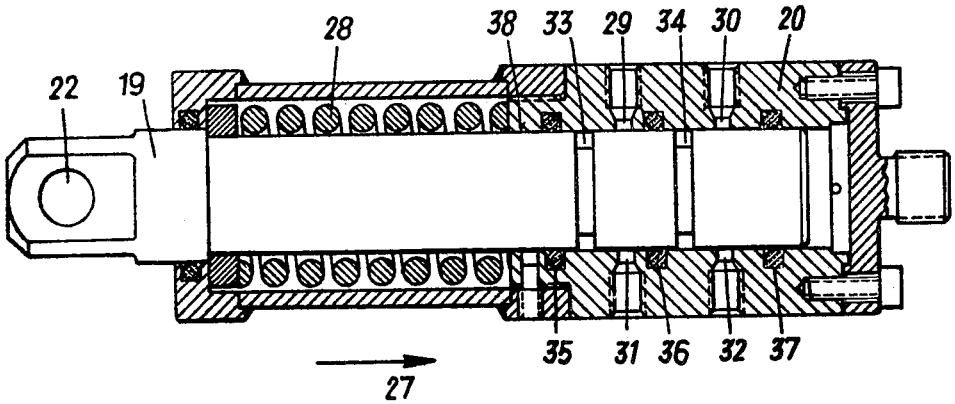

FIG. 5 shows the valve formed by the valve sleeve and the cylinder in an axial section through the cylinder.

The cutting arm 1 of the cutting machine shown in FIGS. 1 and 2 can be swiveled around the horizontal axis 3 in the direction of the arrow 2. At the same time, this cutting arm can also be swiveled around a vertical axis 4. The loading ramp 5 is pivoted at the frame 7 of the cutting machine so that it can be swiveled around a horizontal axis 6. The swiveling of the swivel arm in the direction of the arrow 2 is carried out by a pair of hydraulic cylinders 8. The swiveling of the loading ramp in the direction of the arrow 9 is carried out by a pair of hydraulic cylinders 10. 11 are the cutting heads. By means of loading arms 12 which are disposed on the loading ramp 5, the drive pulleys of which are called 13, the cut material is conveyed upward to the center on the loading ramp and reaches a conveying device 14, which may, for example, be a conveyor belt. Rigid stops 15 are provided at both sides of the center of the loading ramp which interact with movable stops 16 at the cutting arm 1, before the cutting arm 1 and the loading ramp 5 can collide.

Figure 3:
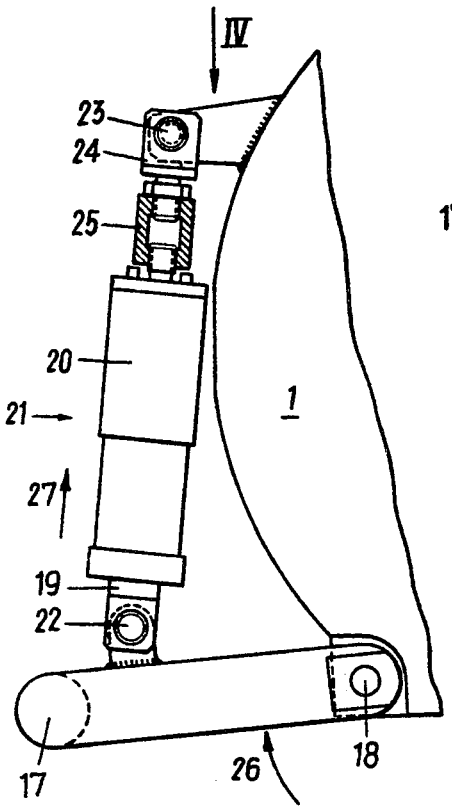
Figure 4:
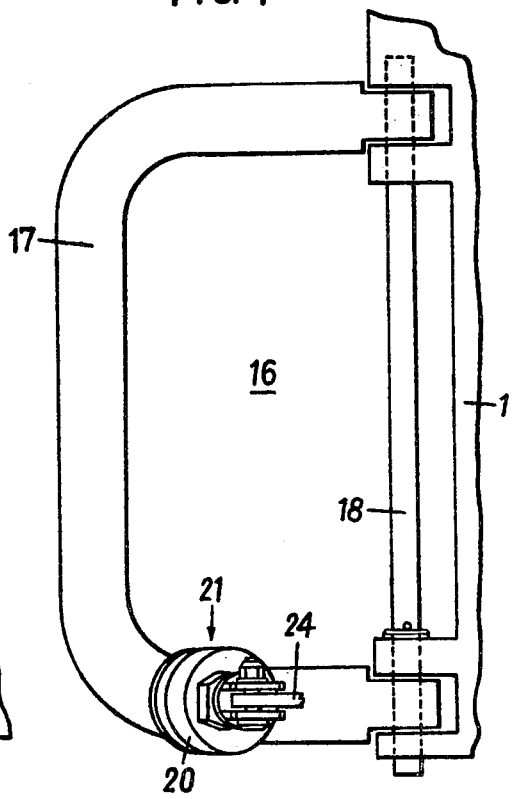

As shown in FIGS. 3 and 4, the movable stops 16 which are on both sides disposed at the cutting arm 1 consist of one bow 17 each which by means of an axis 18 is pivoted at the cutting arm 1, and which is supported against the cutting arm 1 by a valve 21 formed by a sleeve valve 19 and a cylinder 20. The sleeve valve 19 is pivoted at the bow 17 by means of an axis 22, and the cylinder 20 is pivoted at the cutting arm by means of an axis 23. The pivot tongue 24 is connected with the cylinder 20 by a socket 25 with right-hand thread and left-hand thread, so that the position of the bow 17 can be adjusted. In the case of a collision with a stop 15, the bow 17 is now swiveled upward in the direction of the arrow 26, and the sleeve valve 19 is slid into the cylinder 20 in the direction of the arrow 27.

The sleeve valve 19 contained in the cylinder 20 is by means of a spring 28 pressed into the left final position shown in FIG. 5. Openings 29, 30 are provided in the cylinder 20. A connecting lead to the hydraulic lead leading to the cutting arm is connected at the connection 29, and a connecting lead to the hydraulic lead operating the loading ramp is connected to the opening 30. The same types of openings 31, 32 are provided at the other side of the cylinder. Return flow leads are connected to these openings 31, 32. These openinges 29 und 30, in the position shown in FIG. 5, are shut by the sleeve valve 19. The sleeve valve 19 has two ring grooves 33 and 34, which in the case of a movement of the sleeve valve to the right, connect the opening 29 with the opening 31 and the opening 30 with the opening 32. The sleeve valve 19 reaches this position in the case of a collision of the stop 15 with the bow 17, and in this position, the pressure leads leading to the cutting arm and to the loading ramp are relieved, so that the movement of cutting arm and loading ramp is stopped immediately.

35, 36 and 37 are ring seals which seal the valve sleeve 19 in the valve face 38 formed by the cylinder 20.

I claim:

1. A cutting machine having a frame on which a cutting arm is attached, said cutting arm including at least one cutting head which can be swiveled around a horizontal axis and a vertical axis, a loading ramp pivotally attached to said frame and disposed below said cutting arm so that it can be swiveled around a horizontal axis, first hydraulic drive means for effecting the lifting and lowering of said cutting arm, second hydraulic drive means for moving said loading ramp and stopping means responsive to changes in the relative vertical distance between said cutting arm and said loading ramp for stopping further movement of said cutting arm and said loading ramp toward one another when the vertical distance between said cutting arm and said loading ramp does not exceed a first predetermined distance, said stop means including a first and second stop member respectively mounted on said cutting arm and said loading ramp so as to come into engagement with one another as said cutting arm and said loading ramp are pivoted toward one another, at least one of said first and second stop members being movably mounted, said movably mounted stop member including a pivotally mounted elongated actuating member and valve means for relieving pressure in said first and second hydraulic drive means in response to movement of said movable stop member when said first predetermined distance is not exceeded, and the other of said stop members includes an elongated member for mating with the elongated actuating member in said movable stop member, said stop means including two pairs of said first and second stop members said pairs being respectively mounted on opposite sides of said cutting arm and said loading ramp so that as said cutting arm traverses back and forth over said loading ramp the elongated member of one of the two pairs of stop members will abut if said first predetermined distance is not exceeded.

2. A cutting machine as in claim 1 wherein said first and second stop members are respectively positioned outwardly from the point at which said cutting arm and said loading ramp are attached to the frame.

3. A cutting machine as in claim 1 wherein said valve means includes a fixed outer valve member having opposed valve openings and a movable inner valve member for controlling the connecting together of said opposed valve openings in response to the movement of said cutting arm and said loading ramp toward one another, said outer member having valve openings on one side connected to the hydraulic leads to said first hydraulic drive means of said cutting arm and said second hydraulic drive means of loading ramp and the opposed valve openings connected to hydraulic return flow lines, said inner valve member having means for maintaining the opposed valve openings in a disconnected condition when said first predetermined distance is exceeded and means for connecting the opposed valve openings together when inner valve member is moved to the extent that said first predetermined distance is not exceeded.

4. A cutting machine as in claim 3 wherein said fixed outer valve member is a cylinder, said movable inner valve member is an axially movable valve slidably retained therein, said valve means further includes spring means for holding said valve in a normally closed position wherein the opposed valve openings are disconnected.

5. A cutting means as in claim 4 wherein said means for connecting the opposed valve openings together comprises control grooves extending around said valve.

6. A cutting machine as in claim 1 wherein said movable member is mounted so as to be pivoted at said cutting arm.

* * * * *